US005408049A

United States Patent [19]

Gale et al.

[11] Patent Number: 5,408,049

[45] Date of Patent: Apr. 18, 1995

[54] MULTIPLE-PHASE ELECTRICAL SYSTEM

[75] Inventors: Allan R. Gale, Allen Park; Michael P. Ciaccio, Canton; Jerry E. Amey, Livonia, all of Mich.

[73] Assignee: Ford Motor Company, Dearborn, Mich.

[21] Appl. No.: 143,585

[22] Filed: Nov. 1, 1993

[51] Int. Cl.[6] ..... H01B 9/00

[52] U.S. Cl. ..... 174/105 R; 174/107; 174/109; 307/147

[58] Field of Search ..... 174/102 R, 105 R, 109, 174/107; 363/123, 135, 136; 307/147

[56] References Cited

U.S. PATENT DOCUMENTS

| | | | |
|---|---|---|---|
| 896,700 | 8/1906 | Atwood | 174/105 R |
| 2,376,101 | 5/1945 | Tyzzer | 174/105 R |
| 2,520,705 | 8/1950 | Wittlinger . | |
| 3,484,679 | 12/1969 | Hodgson et al. | 174/105 R |
| 3,571,613 | 3/1971 | Plate et al. | 307/147 |
| 3,651,443 | 3/1972 | Quilez | 439/112 |
| 3,848,179 | 11/1974 | Kayama | 323/22 T |
| 3,876,823 | 4/1975 | Penczynski | 174/128 |
| 4,423,620 | 1/1984 | Hogenhout et al. | 174/75 C |
| 4,487,996 | 12/1984 | Rabinowitz et al. | 174/105 R |
| 4,614,926 | 9/1986 | Reed et al. | 333/244 |
| 4,806,425 | 2/1989 | Chu-Ba | 174/110 V |
| 4,910,359 | 3/1990 | Dougherty et al. | 174/110 V |
| 4,942,511 | 7/1990 | Lipo et al. | 363/136 |
| 5,147,983 | 9/1992 | Ashley | 174/104 |
| 5,304,739 | 4/1994 | Klug et al. | 174/102 |

FOREIGN PATENT DOCUMENTS

| | | | |
|---|---|---|---|
| 1034 | 10/1886 | United Kingdom | 174/105 R |

*Primary Examiner*—Morris H. Nimmo

*Attorney, Agent, or Firm*—Mark S. Sparschu; Roger L. May

[57] ABSTRACT

An electrical system comprises an inverter, a three-phase electric motor and a cable to transfer energy from the inverter to the motor. The cable further comprises a center conductor and two additional conductors disposed about the center conductor. Insulators physically and electrically separate the conductors from one another. Electromagnetic emissions from the cable are substantially prevented due to the construction of the cable.

12 Claims, 1 Drawing Sheet

MULTIPLE-PHASE ELECTRICAL SYSTEM

BACKGROUND OF THE INVENTION

1. Field of the Invention

The invention relates to an electrical system which includes a cable to transfer electrical power within the system. The invention further relates to the cable which transfers electrical power.

2. Background of the Related Art

It is well-known that in the distribution of electrical energy, electromagnetic emissions can occur. These emissions take the form of electric fields and magnetic fields.

Where the electrical energy being distributed is of relatively high voltage, relatively high current, or both, the electromagnetic emissions are often higher than in the distribution of low-level electrical signals. Where the distribution of electrical energy occurs in an automobile, there is further concern about electromagnetic emissions. One reason for this further concern is the large quantity of electronics in a typical automobile. Those electronics can be susceptible to electromagnetic emissions. Another reason for the concern is the relative proximity of the various electronic components in an automobile. A relatively small amount of electromagnetic emission can therefore affect a large number of electronic components.

It is known in the art to use coaxial cable to transfer low-level and higher power electrical signals. This coaxial cable has a center conductor surrounded by an insulator and an outer conductor. Current flowing in the cable flows in one conductor and returns in the other. The balancing of the currents substantially prevents electromagnetic emissions from the cable and substantially protects low-level signals in the cable from interference by external electromagnetic fields.

A useful form of electrical power is alternating-current multiple-phase power. There, each phase has a voltage which is separated from the other phase voltages by an angular difference. Ashley in U.S. Pat. No. 5,147,983 teaches one way to transfer multiple-phase electrical power. There, individual phases of a multiple-phase power distribution system are carried by coaxial cables. However, the result is a multiplicity of coaxial cables to carry the multiple phases. The multiplicity of coaxial cables can result in an undesirable bulk and weight. This bulk and weight are drawbacks especially in automobiles, where multiple-phase electrical power is becoming increasingly important as a power source for propulsion of electric automobiles.

Given the lack of attractive solutions to the problem of electromagnetic emissions due to the distribution of multiple-phase electrical power, a single cable which transmits multiple-phase power with little or no electromagnetic emissions would provide significant advantages over the prior art.

SUMMARY OF THE INVENTION

The present invention provides an electrical system for distributing multiple-phase electrical power having at least three phases. The system comprises a multiple-phase electrical power source having at least three phases, the phases having a substantially equally-spaced angular relationship. The system further comprises a multiple-phase electrical load with the same number of phases as the power source. This load presents a substantially equal electrical load on each phase of the multiple-phase power source. Finally, the system comprises a cable for transferring electrical power from the power source to the load. The cable comprises a number of conductors equal to the number of phases of the electrical power source. The conductors are arranged such that one conductor is in the center and the remainder of the conductors are disposed about the center conductor. Insulators electrically and physically separate the conductors from one another. Finally, an insulating jacket is disposed about the outermost conductor. Each conductor of the cable is connected to one phase of the power source and to one phase of the load.

This invention solves the problem described above in the distribution of three-phase electrical power. Power from the power source to the load is transferred via a single cable. That cable provides for substantial elimination of electromagnetic emissions from the cable. The single cable further can provide reduced mass, volume and cost with respect to available alternatives.

DETAILED DESCRIPTION OF THE INVENTION

Figure 1:
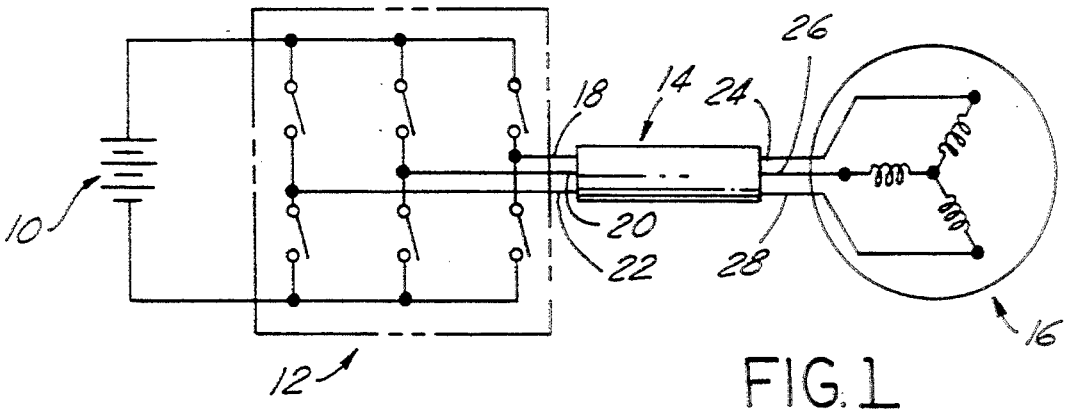
FIG. 1 is a schematic drawing of the electrical system of the present invention.

One embodiment of the present invention is directed to an electrical system. Referring to FIG. 1, the electrical system comprises a battery 10, an inverter 12, an electrical cable 14 and a three-phase electric motor 16.

Figure 2:
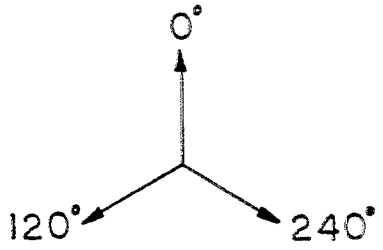
FIG. 2 is a phase diagram of the three phases generated by the inverter in the electrical system of FIG. 1.

Inverter 12 takes direct current (DC) power from battery 10 and converts it to three-phase electrical power in a manner well-known in the art. The outputs from the inverter for the three phases produced by the inverter are designated 18, 20, and 22 in FIG. 1. The phase voltages are substantially equally spaced in their angular relationship. FIG. 2 shows the angular relationship of the phase voltages at one instant in time. Because inverter 12 produces three phases, and because the phases are substantially equally spaced in their angular relationship, the phase voltages shown in FIG. 2 are approximately 120 degrees apart.

Motor 16 is a three-phase electric motor. Motor 16 has inputs 24, 26 and 28. Each input 24, 26 and 28 is an input for one phase of electrical power. As is customary with three-phase electric motors, motor 16 presents a substantially equivalent load to all three of its inputs. That is, when connected to a three-phase voltage source in which all voltages are of substantially the same magnitude, such as inverter 12, motor 16 will draw currents of substantially equal magnitude from all three phases. Furthermore, because the phase voltages in inverter 12 are substantially equally angularly spaced, the currents drawn by motor 16 from all three phases will be substantially equally angularly spaced.

Figure 3:
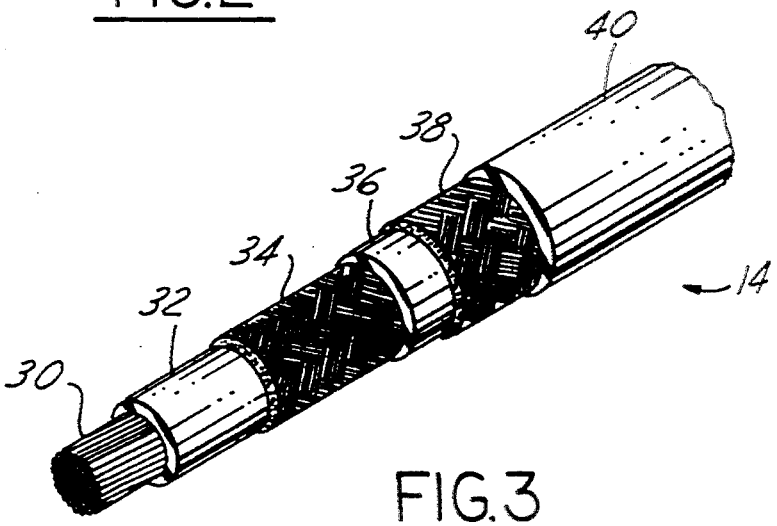
FIG. 3 is a perspective drawing showing the construction of the electrical cable of FIG. 1.

Inverter 12 and motor 16 are connected by cable 14. Referring to FIG. 3, cable 14 comprises a center conductor 30; a first insulator 32 disposed about center conductor 30; a second conductor 34 disposed about center conductor 30 and first insulator 32; a second insulator 36 disposed about center conductor 30, first insulator 32 and second conductor 34; a third conductor 38 disposed about center conductor 30, first insulator 32, second conductor 34 and second insulator 36; and an insulating jacket 40 disposed about all of the above conductors and insulators 30, 32, 34, 36 and 38.

Center conductor 30 is composed of stranded copper wire and is of sufficient cross-sectional area to conduct the current drawn on one phase from inverter 12 by motor 16.

First insulator 32 is composed of polyvinyl chloride (PVC), a common wire insulation material. First insulator 32 has a thickness sufficient to substantially prevent electrical current flow between center conductor 30 and second conductor 34. This thickness, the determination of which is known to a person skilled in the art, is a function of the voltage between the phases connected to center conductor 30 and second conductor 34.

Second conductor 34 is composed of stranded copper wire which is braided. Second conductor 34 is of sufficient cross-sectional area to conduct the current drawn on one phase by motor 16.

Second insulator 36 is composed of PVC and has a thickness sufficient to prevent current flow between second conductor 34 and third conductor 38. This thickness, the determination of which is known to a person skilled in the art, is a function of the voltage between the phases connected to second conductor 34 and third conductor 38.

Third conductor 38 is composed of stranded copper wire which is braided. Third conductor 38 is of sufficient cross-sectional area to conduct the current drawn on one phase by motor 16.

Insulating jacket 40 is composed of PVC and is of sufficient thickness to insulate third conductor 38 and to protect cable 14. The selection of the thickness of insulating jacket 40 is similar to the selection of the outer insulation of other cables known in the art.

Cable 14 effects electrical connection between inverter 12 and motor 16 as follows. One end of center conductor 30 is electrically connected to output 18 of inverter 12. The other end of center conductor 30 is electrically connected to input 24 of motor 16. Similarly, second conductor 34 of cable 14 is electrically connected to output 20 of inverter 12 and to input 26 of motor 16. Finally, third conductor 38 of cable 14 is electrically connected to output 22 of inverter 12 and to input 28 of motor 16.

An optimal length of cable 14 is chosen with regard to the wavelength of the multiple-phase power being transmitted. Any alternating current electrical energy has a wavelength which is calculated using the relationship $\lambda=c/f$, where c is the speed of light (300,000,000 meters per second), f is the frequency of the electrical energy in cycles per second and $\lambda$ is the wavelength in meters. It is most advantageous for cable 14 to have a length much less than a wavelength of the electrical energy being transmitted by cable 14. In that case, effects of wave propagation theory as they relate to the efficiency of power transmission in cable 14 are negligible. That is, efficient power transmission in cable 14 is achieved without regard to the application of transmission line and wave propagation theory.

As an example of the selection of the length of cable 14, consider the frequency of the multiple-phase electrical power to be 480 cycles per second. In that case, the wavelength $\lambda$ is 300,000,000/480, or 600,000 meters. Cable 14 would thus optimally be chosen to be much less than 600,000 meters in length.

That electromagnetic emissions from cable 14 are prevented in the electrical system of FIG. 1 is explained as follows. As inverter 12 transfers electric power to motor 16 via cable 14, the summation of the currents in the three conductors 30, 34 and 38 at any point along the length of cable 14 is zero or nearly zero. The summation is zero or nearly zero because the magnitudes of the currents in the three conductors are approximately equal and because the three currents have substantially equal angular spacing. An example of such equal angular spacing is illustrated in FIG. 2. Vector addition of the three phase currents results in a net sum of zero, or nearly zero, current. This sum of substantially zero current at all points along the length of cable 14 causes essentially no electromagnetic fields to be emitted outside cable 14 by the currents travelling within cable 14.

A second embodiment of the present invention is cable 14 illustrated in FIGS. 1 and 3.

Various modifications and variations will no doubt occur to those skilled in the arts to which this invention pertains. Such variations which generally rely on the teachings through which this disclosure has advanced the art are properly considered within the scope of this invention. For example, inverter 12 and motor 16 can be replaced by any multiple-phase electrical power source having at least three phases and any multiple-phase electrical load with the same number of phases such that the phase currents drawn by the electrical load have a net sum of zero or nearly zero current. In addition, conductors 30, 34 and 38 of cable 14 can be other conducting material than copper and can be formed from other than stranded material. As a further example, insulators 32 and 36 of cable 14 can be other insulating material than PVC.

What is claimed is:

1. An electrical system comprising:

a multiple-phase electrical power source having at least three phases, the phases having phase voltages of substantially equal magnitude and substantially equal angular spacing;

a multiple-phase electrical load having a number of phases equal to the number of phases of the multiple-phase power source and which presents a substantially equal electrical load on each phase; and a cable for transferring power from the power source to the load, the cable further comprising:

a center conductor with a cross-sectional area, the cross-sectional area being sufficient to carry the current drawn by the load on one phase of said power source;

a number of additional conductors disposed about the center conductor, the total number of conductors including the center conductor being equal to the number of phases of said multiple-phase electrical power source, said additional conductors each having a cross-sectional area sufficient to carry the current drawn by the load on one phase of said power source;

a number of insulators, each insulator disposed between two conductors, each insulator further being of sufficient thickness to substantially prevent current flow between the two conductors between which the insulator is disposed; and an insulating jacket disposed around all of the conductors and insulators;

wherein each conductor of said cable is electrically connected to one phase of the multiple-phase electrical power source and one phase of the load, whereby electrical power is transferred from the power source to the load.

2. An electrical system as recited in claim 1, wherein said multiple-phase electrical power source has three phases.

3. An electrical system as recited in claim 2, wherein said additional conductors and said insulators have cross sections shaped substantially as circular annuluses.

4. An electrical system as recited in claim 3, wherein said center conductor has a substantially circular cross section.

5. An electrical system as recited in claim 4, wherein said center conductor, said additional conductors, and said insulators are substantially concentric.

6. An electrical system as recited in claim 5 wherein said multiple-phase electrical power source generates electrical power at a frequency of approximately 480 cycles per second.

7. An electrical system as recited in claim 6 wherein said cable has a length much less than 600,000 meters.

8. An electrical system as recited in claim 7 wherein said cable has a length of less than 100 feet.

9. An electrical system as recited in claim 5, wherein said insulators comprise polyvinyl chloride, said center conductor comprises stranded copper wire, said additional conductors comprise woven stranded copper wire, and said insulating jacket comprises polyvinyl chloride.

10. An electrical system as recited in claim 9 wherein said multiple-phase electrical power source generates electrical power at a frequency of approximately 480 cycles per second.

11. An electrical system as recited in claim 10 wherein said cable has a length of much less than 600,000 meters.

12. An electrical system as recited in claim 11 wherein said cable has a length of less than 100 feet.

* * * * *